US006619494B1

(12) United States Patent
Brozell et al.

(10) Patent No.: US 6,619,494 B1
(45) Date of Patent: Sep. 16, 2003

(54) TABLET PACKAGE INCLUDING A TABLET HOLD-DOWN DEVICE

(75) Inventors: Brian J. Brozell, Toledo, OH (US); Stephen A. Eilertson, Perrysburg, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 10/094,753

(22) Filed: Mar. 11, 2002

Related U.S. Application Data

(63) Continuation of application No. 09/619,091, filed on Jul. 19, 2000.

(51) Int. Cl.[7] ..... B65D 39/00; B65D 51/20

(52) U.S. Cl. ..... 215/231; 206/540; 206/814; 206/828; 220/578

(58) Field of Search ..... 215/231, 355, 215/321; 220/518, 578, 580; 206/540, 814, 828, 528

(56) References Cited

U.S. PATENT DOCUMENTS

| | | | |
|---|---|---|---|
| 516,303 | A | 3/1894 | Goldwater |
| 567,488 | A | 9/1896 | Moehn |
| 727,988 | A | 5/1903 | Maxson |
| 1,183,714 | A | 5/1916 | Armstrong |
| 1,554,066 | A | 1/1925 | Boros |
| 1,654,914 | A | 1/1928 | Beery |
| 2,222,042 | A | 11/1940 | Nitardy et al. |
| 2,767,864 | A | 10/1956 | Van Litsenburg |
| 2,820,564 | A | 1/1958 | Solomon |
| 2,884,149 | A | 4/1959 | Zimmermann |
| 2,937,745 | A | 5/1960 | Wilson |
| 3,033,409 | A | 5/1962 | Lind |
| 3,075,667 | A | 1/1963 | Lind |
| 3,169,654 | A | 2/1965 | Pollklesener |
| 3,225,509 | A | 12/1965 | May |
| 3,580,409 | A | 5/1971 | Soboleski |
| 4,215,786 | A | 8/1980 | Vertes |
| 4,279,351 | A | 7/1981 | Vertes |
| 4,418,826 | A | 12/1983 | Mancini et al. |
| 4,782,941 | A | 11/1988 | Freise |
| 4,805,789 | A | 2/1989 | Lancesseur et al. |
| 4,899,876 | A | 2/1990 | Murphy et al. |
| 4,899,897 | A | 2/1990 | Buttiker et al. |
| 5,096,078 | A | 3/1992 | McQueeny |
| 5,316,146 | A | 5/1994 | Graff |
| 5,411,156 | A | 5/1995 | Reckamp |
| 5,738,234 | A | 4/1998 | Harrold |

FOREIGN PATENT DOCUMENTS

| | | |
|---|---|---|
| AT | 244219 | 12/1965 |
| AT | 259766 | 2/1968 |
| CH | 309026 | 2/1953 |
| CH | 404857 | 12/1965 |
| DE | 27917 | 5/1962 |
| FR | 781339 | 12/1958 |
| FR | 915516 | 11/1962 |
| FR | 94969 | 2/1967 |
| IT | 594835 | 7/1958 |
| SE | 304808 | 12/1962 |

*Primary Examiner*—Stephen K. Cronin
*Assistant Examiner*—Niki M. Eloshway

(57) ABSTRACT

A package for tablet products that includes a container having an interior volume for holding the tablet products and a closure secured to a cylindrical finish of the container. A product hold-down device has an axially resilient central portion, a lower portion for engaging the upper surface of the product within the container, and an upper portion for securement within the container finish to hold the device in place within the finish, with the closure removed from the finish, against the axially resilient forces applied to the device by engagement of the lower portion with product in the container and resilient compression of the central portion of the device. Thus, the hold-down device can be inserted into the container and secured to the container using automatic packaging equipment, and the container closure then applied to the container. In use, the closure is removed from the container, and the device is removed and discarded by the user.

14 Claims, 7 Drawing Sheets

TABLET PACKAGE INCLUDING A TABLET HOLD-DOWN DEVICE

This application is a continuation of application Ser. No. 09/619,091 filed Jul. 19, 2000.

The present invention is directed to tablet packages, and more particularly to a device for holding the tablets in position during shipping and handling of the package.

BACKGROUND AND SUMMARY OF THE INVENTION

It is the current practice when packaging many types of tablets, such as aspirin or vitamins, to place a wad of cotton in the headspace of the container, before application of the container closure, to keep the tablets from moving during handling and shipment. There can be problems associated with sterility of the cotton and bleach used to whiten the cotton. It is a general object of the present disclosure to provide a hold-down device that eliminates any requirement for this addition of cotton during the packaging process. Another and related object of the present invention is to provide a package for tablet products that contains such a device, and a method of packaging tablet products, that are amenable to implementation in automatic packaging equipment.

A package for tablet products in accordance with presently preferred embodiments of the invention includes a container having an interior volume for holding the tablet products and a closure secured to a cylindrical finish of the container. A product hold-down device has an axially resilient central portion, a lower portion for engaging the upper surface of the product within the container, and an upper portion for securement within the container finish to hold the device in place within the finish, with the closure removed from the finish, against the axially resilient forces applied to the device by engagement of the lower portion with product in the container and resilient compression of the central portion of the device. Thus, the hold-down device can be inserted into the container and secured to the container using automatic packaging equipment, and the container closure then applied to the container. In use, the closure is removed from the container, and the device is removed and discarded by the user to obtain access to the tablet product.

In the preferred embodiments of the invention, the container finish has an internal bead or channel, and the upper portion of the device is in the form of an annular ring received by snap fit within the finish beneath the bead or within the channel. The lower portion of the device comprises a plurality of radially extending petals, preferably projecting radially from a flat central disk. The mid portion of the device is in the form of an axially compressible spring. This mid portion may take the form of circumferentially staggered coil or spiral springs, or an axially compressible lattice-like structure. In other preferred embodiments of the invention, the hold-down device takes the form of a spiral spring having an upper portion in radial compression within the container finish.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
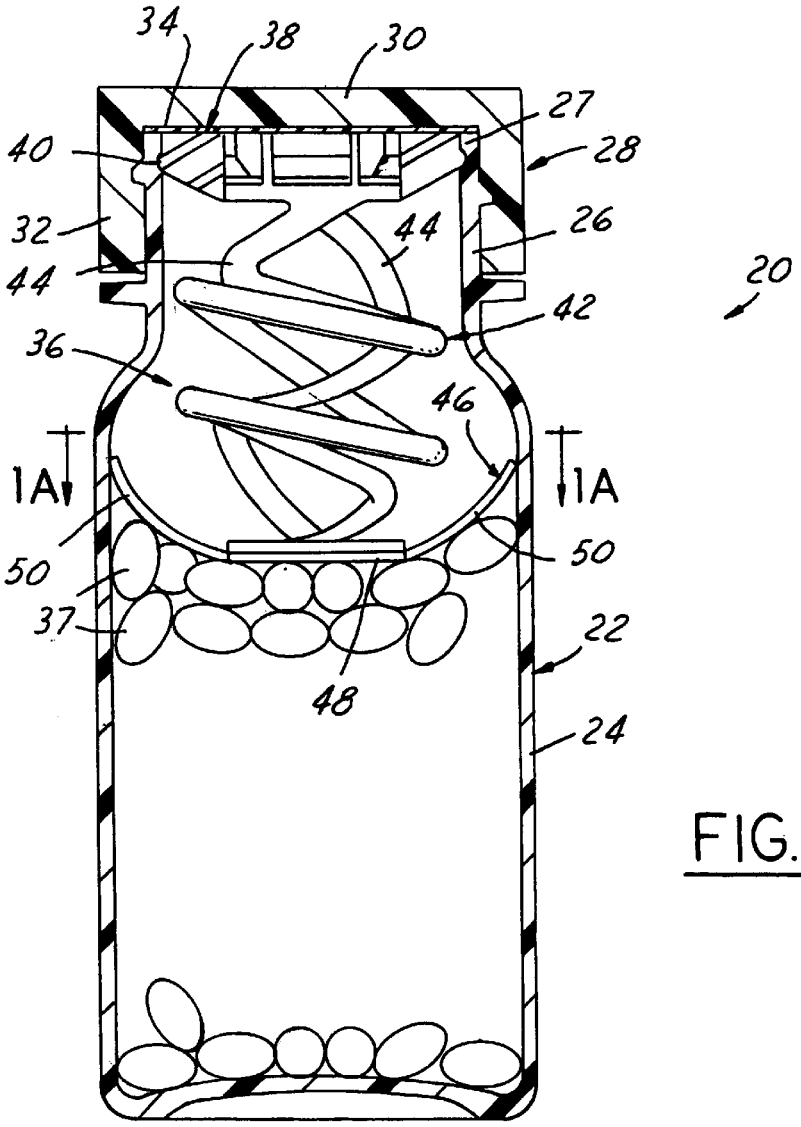
FIG. 1 is an elevational view bisecting a package in accordance with one presently preferred embodiment of the invention.
Figure 20:
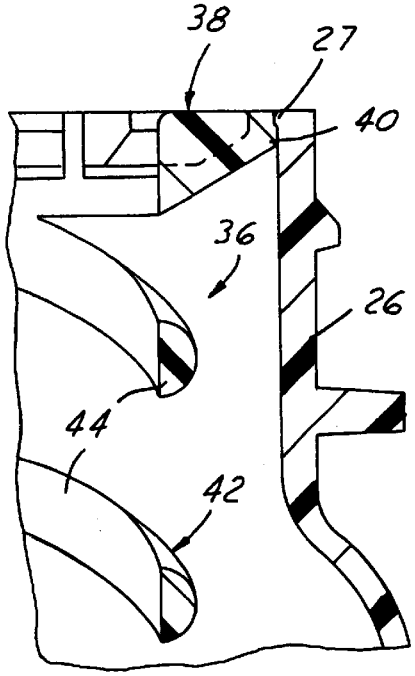
FIG. 20 is a fragmentary sectional view of the container finish and hold-down device of the embodiment of FIGS. 1–6.

FIG. 1 illustrates a package 20 in accordance with one presently preferred embodiment of the invention as comprising a container 22 having a sidewall 24 and a cylindrical finish 26 that terminates in an axial mouth. A continuous or segmented annular bead 27 (FIGS. 1 and 20) projects radially inwardly from the inside diameter of finish 26, preferably adjacent to the open edge thereof, in a plane perpendicular to the axis of the container finish. A closure 28 has a base wall 30 and a peripheral skirt 32 with an internal thread or bead secured over an external thread or bead on finish 26. A liner 34 is disposed between closure base wall 30 and the axial edge of container finish 26, such as by being compression molded in situ or otherwise secured onto the internal face of base wall 30. As an alternative, liner 34 may be a foil-type liner that is induction welded to the upper edge of container finish 26 to provide a tamper-indicating feature. Container 22 is preferably of blow molded plastic composition, and closure 28 may be either injection molded or compression molded of suitable plastic composition.

A hold-down device 36 is secured within container finish 26 and resiliently engages the upper surface of tablets 37 disposed within the body of container 22. Referring to FIGS. 1–6 and 20, device 36 comprises an upper portion 38 in the form of an annular continuous ring having a radially outwardly extending peripheral bead 40. A middle portion 42 of device 36 comprises a pair of circumferentially spaced concentrically coiled legs 44 that depend from diametrically opposed sides of upper ring portion 38. A lower portion 46 of device 36 includes a central flat circular disk 48 that is integrally coupled to the lower ends of legs 44. The plane of disk 48 is parallel to the plane of upper ring portion 38. A plurality of flexible resilient circumferentially spaced petals 50 extend radially outwardly from the periphery of disk 48. The outer edges of petals 50 are on a common circle of revolution (prior to insertion into the container) concentric with the axis of device 36, and are integrally interconnected by a plurality of intervening integral frangible webs 52. Webs 52 help prevent petals 50 from becoming entangled during shipment. Upper ring portion 38 includes an inner ring 54 from which legs 44 depend, and an outer ring 56 on which peripheral bead 40 is formed. Inner and outer rings 54, 56 are interconnected by a plurality of circumferentially spaced radial legs 58. Hold-down device 36 is of one-piece integrally molded construction of suitable inert plastic composition such as high density polyethylene (HDPE), low density polyethylene (LDPE) or thermoplastic elastomer (TPE).

Figure 1A:
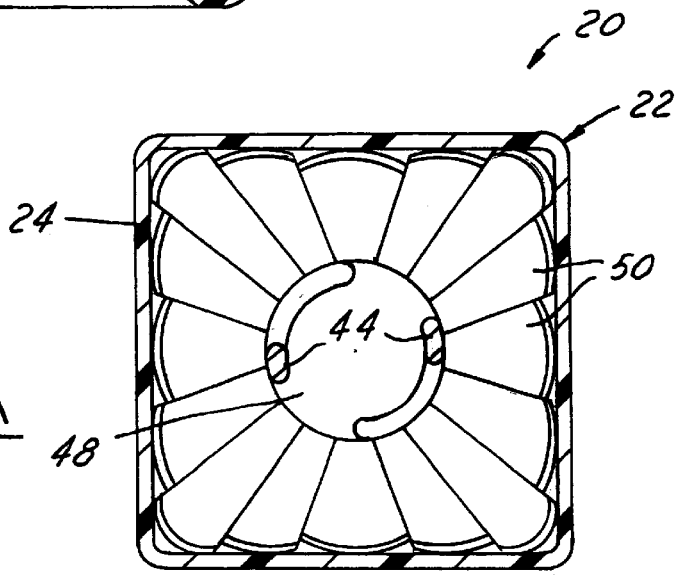
FIG. 1A is a sectional view taken substantially along the line 1A—1A in FIG. 1.
Figure 3:
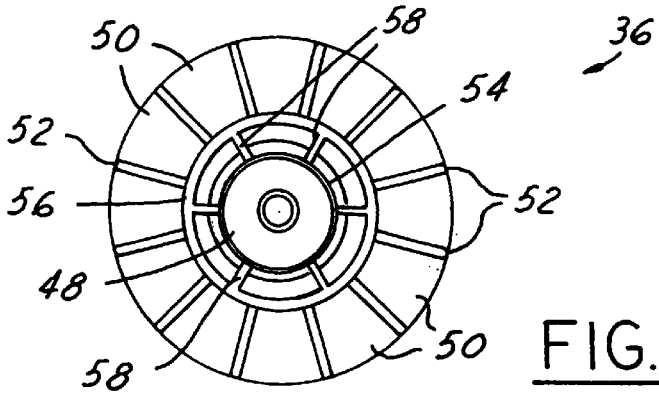
FIG. 3 is a top plan view of the device illustrated in FIG. 2.
Figure 2:
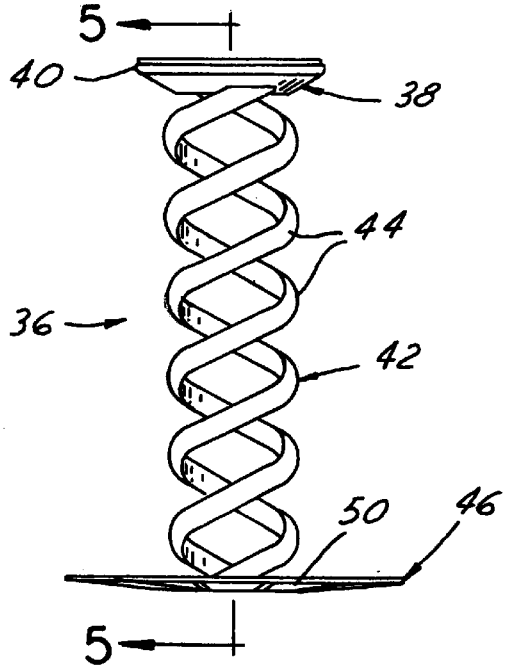
FIG. 2 is a side elevational view of the hold-down device in the embodiment of FIG. 1.
Figure 5:
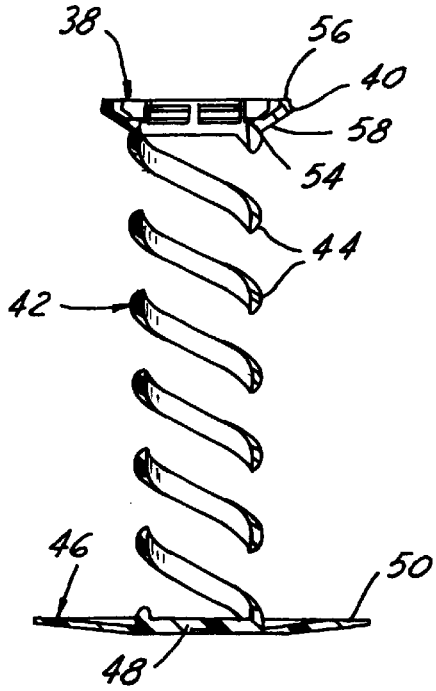
FIG. 5 is a fragmentary sectional view taken substantially along the line 5—5 in FIG. 2; 5
Figure 4:
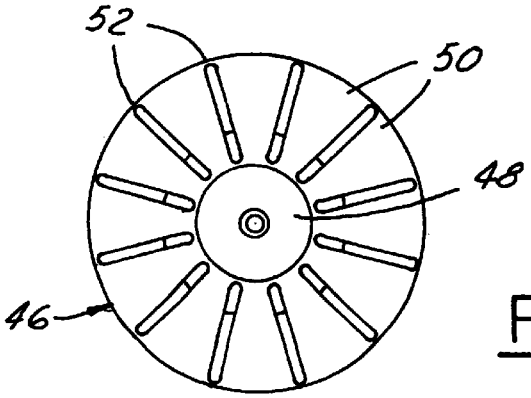
FIG. 4 is a bottom plan view of the device illustrated in FIG. 2.
Figure 6:
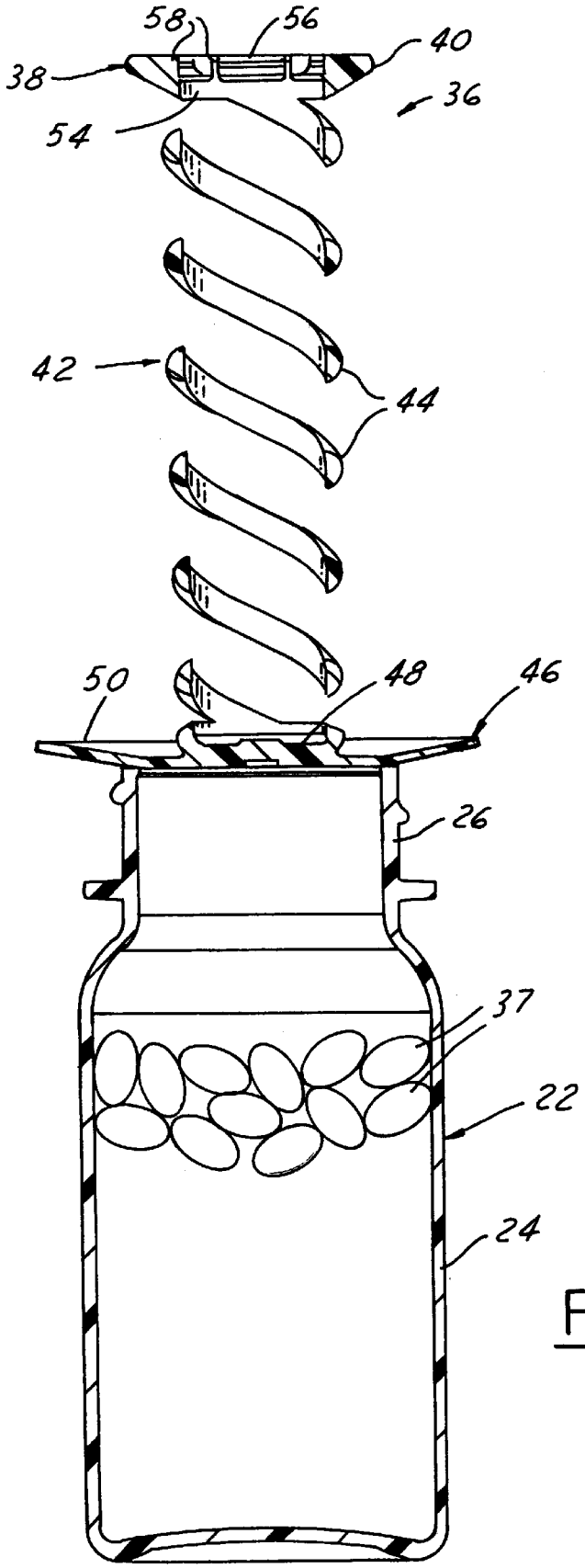
FIG. 6 is a sectional view in side elevation of the hold-down device of FIGS. 1–5 before insertion into the container.
Figure 8:
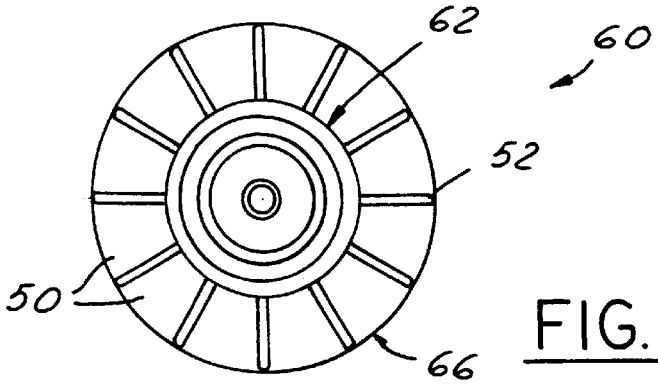
FIGS. 8 and 9 are respective top and bottom plan views of the device illustrated in FIG. 7.
Figure 7:
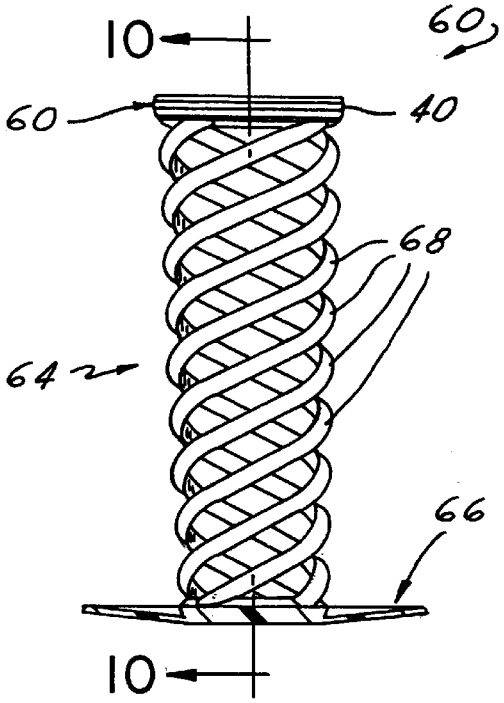
FIG. 7 is a side elevational view similar to that of FIG. 2 but showing a modified embodiment of the invention.
Figure 10:
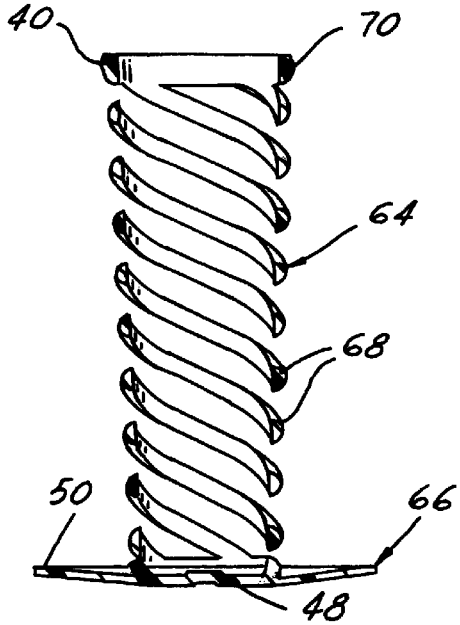
FIG. 10 is a sectional view taken substantially along the line 10—10 in FIG. 7.
Figure 9:
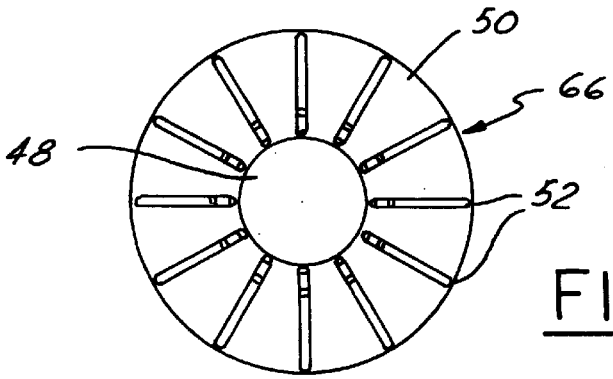

In forming package 20, container 22 is first filled with tablets 37 through the open mouth of container finish 26. Hold-down device 36 is then axially aligned with the container mouth and pressed into the container through the container mouth. As best seen in FIGS. 2 and 5, pedals 50 are preferably angulated upwardly with respect to the plane of disk 48 to facilitate alignment and insertion. Petals 50 flex inwardly and upwardly as lower portion 46 is inserted through the container mouth. Integral webs 52 may rupture at this stage. After lower portion 50 has cleared the container mouth, petals 50 resiliently flex radially outwardly. In the particular embodiment illustrated in FIGS. 1–6 and 20, the outer diameter of petals 50 is greater than the inner diameter of the container body, so that petals 50 remain partially upwardly flexed and slide along the inside surface of the container body. When employed in conjunction with a container having a square or other non-circular sidewall (see FIG. 1A), some petals 50 will remain flexed more than others. (The insert devices of the present application can also be used with containers having a cylindrical sidewall.) Downward motion of device 36 thus brings lower portion 46 into contact with the upper surface of tablets 37 in container 22. Continued downward motion of upper portion 38 compresses spring legs 44 (compare FIGS. 2 and 5–6 to FIG. 1) until upper portion 38 enters the container mouth. Spring legs 44 are designed to have an overall diameter on compression that is less then the inside diameter of the container finish, as best seen in FIG. 1.

Bead 40 on upper portion 38 is secured beneath the radially inwardly oriented bead 27 that surrounds the container mouth (FIGS. 1 and 20), so that device 36 is firmly secured within container 22 against the axial forces resulting from resilient compression of spring legs 44 of middle portion 42. Closure 28 and liner 34 may then be assembled over the open end of container 22 so as to close the container mouth. Securement of upper portion 38 within container finish 26 before closure 28 and liner 34 are assembled to the container simplifies the assembly operation and facilitates use of conventional automated packaging equipment. Hold-down device 36 thus firmly engages the upper surface of tablets 37 and holds the tablets in position during transport and handling of package 20. When the package is ready for use, closure 28 and liner 34 are removed. The user may insert a finger through inner ring 54 of upper ring portion 38 and snap the upper ring portion from beneath bead 27. Device 36 is then manually extracted from the container and discarded, so that tablets 37 may then be freely dispensed from the container.

Figure 13:
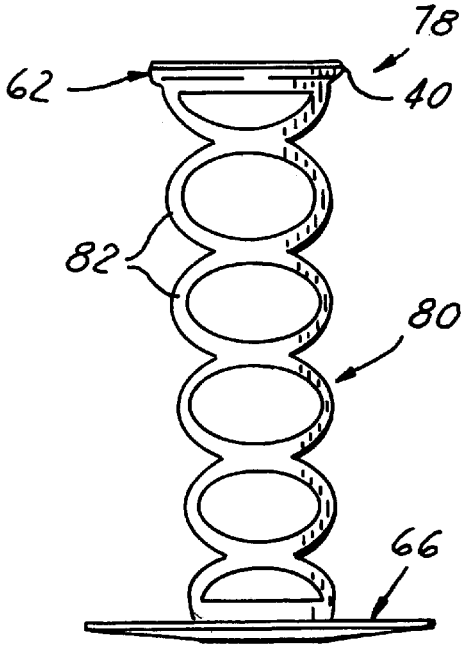
FIG. 13 is a side elevational view of the device of FIG. 12.
Figure 12:
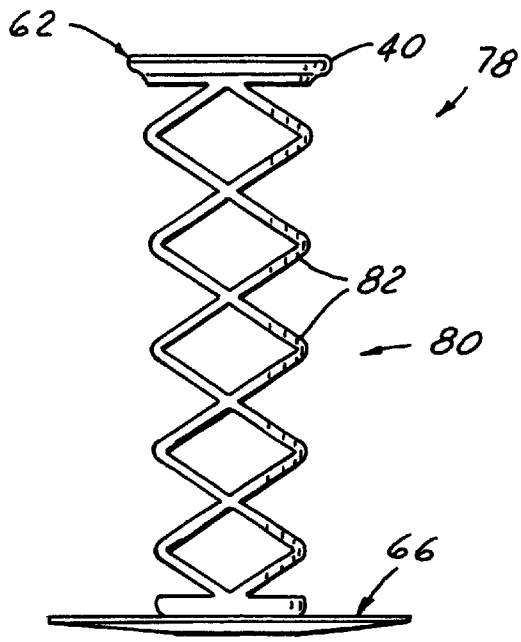
FIGS. 11–12 and 14 are elevational views similar to those of FIGS. 2 and 7 but showing respective additional embodiments of the invention.
Figure 11:
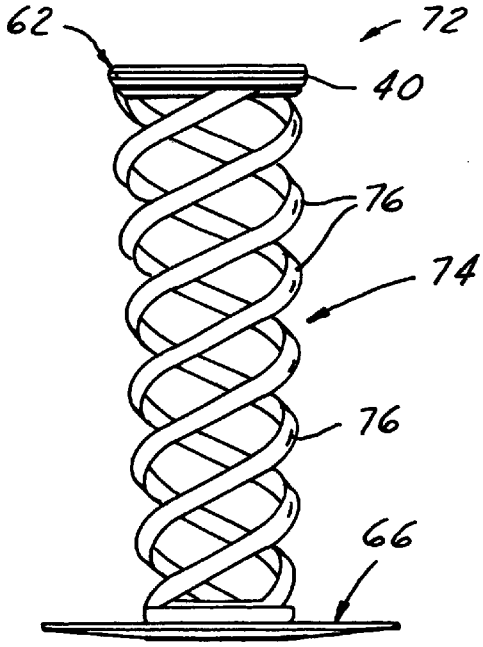
Figure 14:
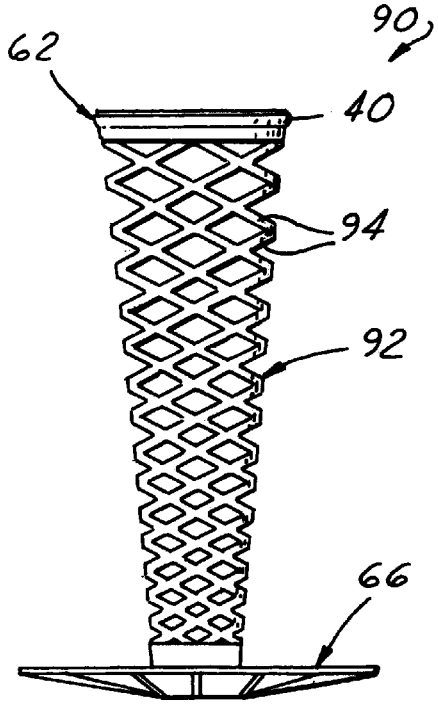
Figure 15:
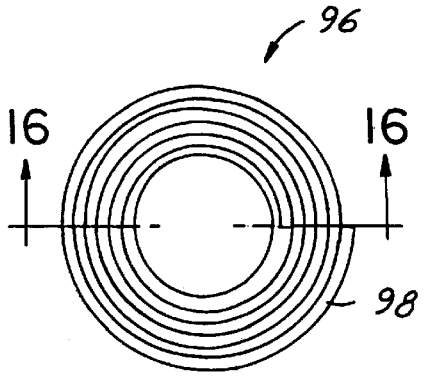
FIG. 15 is a top plan view of a hold-down device in accordance with a further embodiment of the invention.
Figure 16:
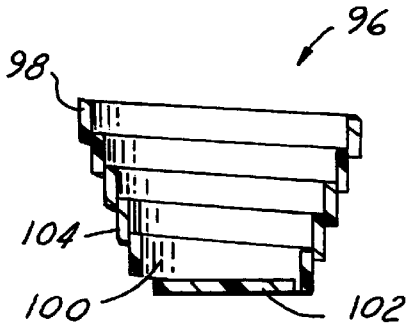
FIG. 16 is a sectional view taken substantially along the line 16—16 in FIG. 15.
Figure 17:
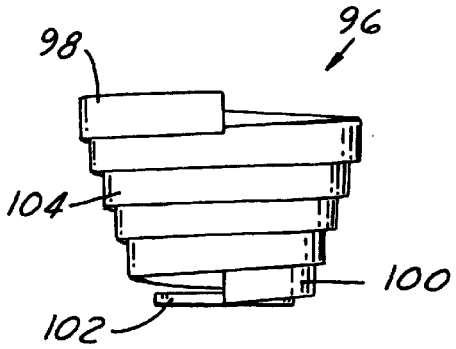
FIG. 17 is a side elevational view of the hold-down device illustrated in FIGS. 15–16.
Figure 18:
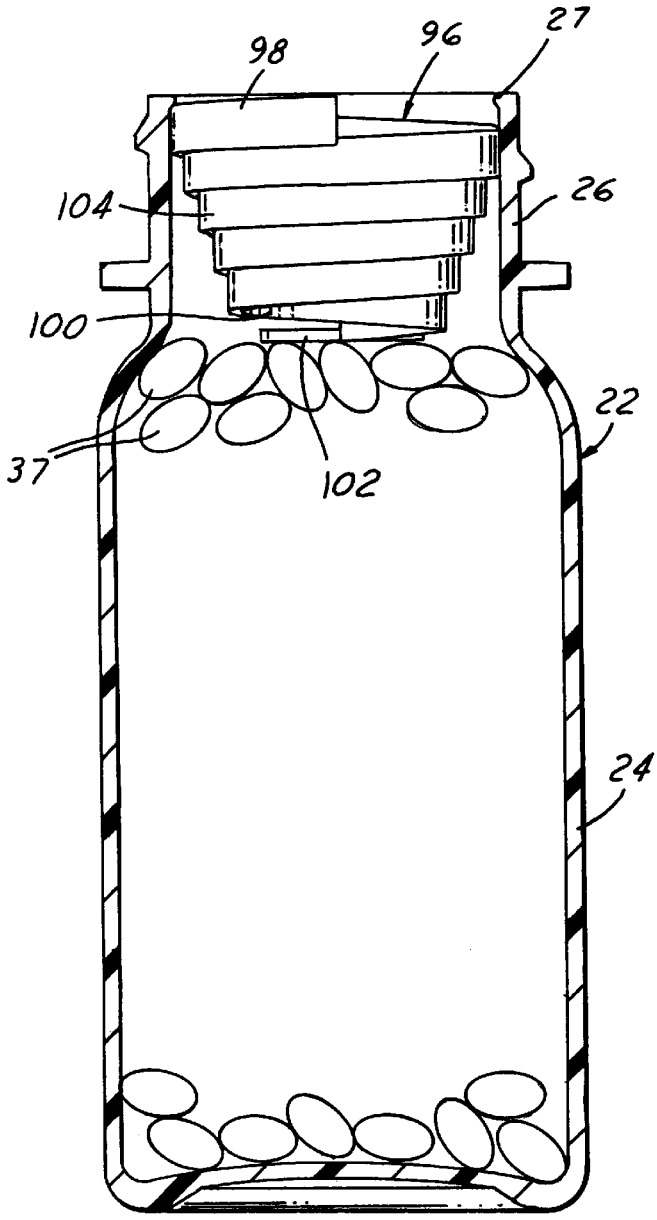
FIG. 18 is an elevation view bisecting a package that embodies the hold-down device of FIGS. 15–17.

FIGS. 7–18 illustrate various modified embodiments of the invention, in which reference numerals identical to those employed in connection with FIGS. 1–6 and 20 illustrate identical or related components. FIGS. 7–10 illustrate a modified hold-down device 60 comprising an upper ring portion 62, a middle portion 64 and a lower portion 66. Middle portion 64 comprises four angularly spaced spiral legs 68 that are coaxial with each other, and which each execute two full turns between upper portion 62 and lower portion 66, as distinguished from the two legs 44 executing three full turns in the embodiment of FIGS. 1–6. Upper portion 62 comprises a single ring 70 having peripheral bead 40. Lower portion 66 comprises central disk portion 48 and radially extending petals 50, which are preferably connected at their outer edges by integral webs 52. Legs 68 in the embodiment of FIGS. 7–10 are of spiral contour, having a decreasing radius with respect to the central axis of device 60 between upper ring portion 62 and lower portion 66, as distinguished from the constant diameter legs 44 in FIGS. 2 and 5 (prior to compression). FIG. 11 illustrates a hold-down device 72, in which mid portion 74 comprises three angularly spaced coaxial spiral legs 76, each of which executes two turns between upper ring portion 62 and lower portion 66. FIGS. 12 and 13 illustrate a hold-down device 78, in which mid portion 80 comprises angulated legs 82 in a lattice-like or bellows-like axially compressible structure. FIG. 14 illustrates a hold-down device 90, in which mid portion 92 comprises closely spaced legs 94, again in a lattice-like axially compressible structure. In all the embodiments of FIGS. 11–14, the mid portions taper narrowingly between upper ring portions 62 and lower portions 66. For the cage-like mid portion constructions of FIGS. 12–14, relatively soft LDPE and TPE materials are preferred. For the open spring leg constructions of FIGS. 1–11, HDPE may be employed.

Figure 19:
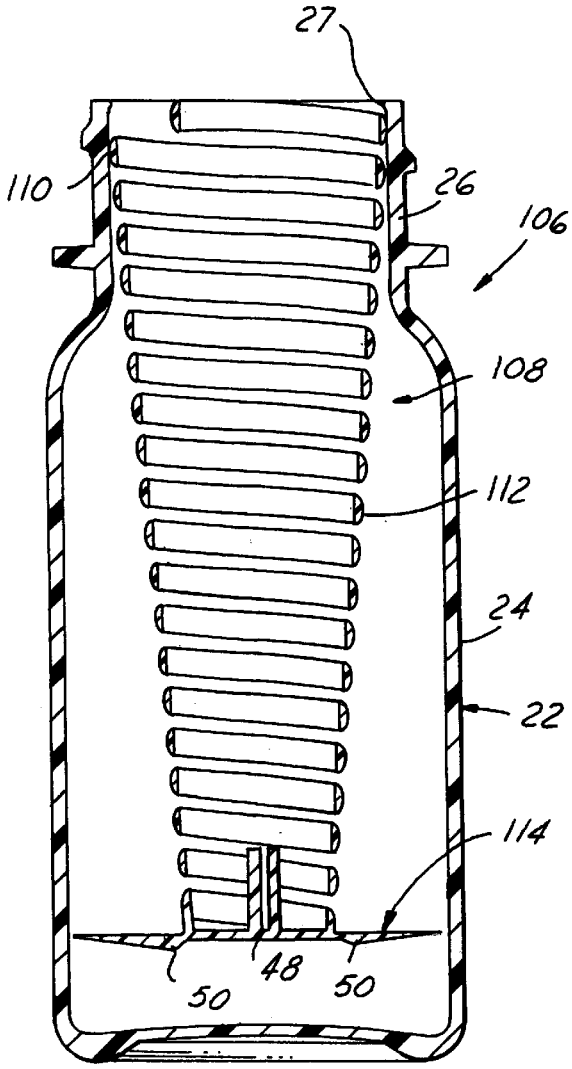
FIG. 19 is a side elevational view that bisects a package in accordance with yet another embodiment of the invention.
Figure 21:
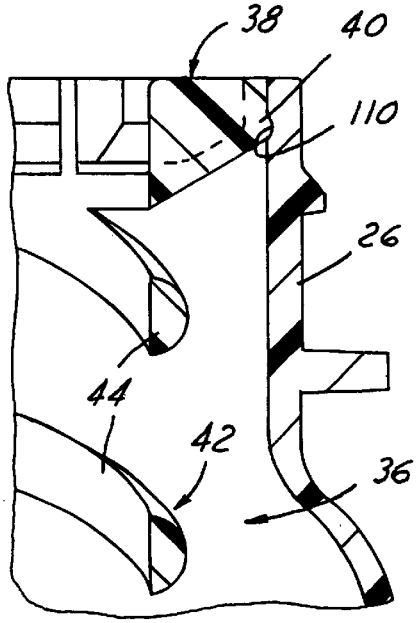
FIG. 21 is a fragmentary sectional view that is similar to that of FIG. 20 but illustrating a modified embodiment of the invention.

FIGS. 15–18 illustrate another embodiment of the invention, in which the hold-down device 96 comprises a continuous spirally coiled plastic spring. The upper portion 98 of spirally coiled hold-down device 96 is circumferentially compressed during insertion into finish 26 of container 22, so that device 98 is retained beneath bead 27 by resilient circumferential expansion into engagement with the inside diameter of finish 26. The lower portion 100 of device 96 comprises a flat circular disk 102 that is in axially resilient engagement with the upper surface of tablets 37 in container 22. The middle portion 104 of device 96 comprises a continuous spiral coil between upper portion 98 and lower portion 100. FIG. 19 illustrates a package 106 that includes a container 22 and a hold-down device 108 in accordance with another embodiment of the invention. Hold-down device 108 includes a continuous spiral spring having an upper portion 110 received beneath container finish bead 27 and held by circumferential compression, a continuous mid portion 112, and a lower end coup led to a lower portion 114 having a central disk 48 and radiating petals 50. Hold-down device 108 in FIG. 19 thus combines the spirally coiled hold-down device 96 of FIGS. 15–18 with a radiating petal lower portion as in the previous embodiments. FIG. 21 illustrates a modification to FIG. 20, in which bead 27 on finish 26 is replaced by a channel 110 that receives bead 40 on ring 38 by snap fit.

There have thus been disclosed a package, a hold-down device and a method of packaging tablets that fully satisfy all of the objects and aims previously set forth. In particular, the use of cotton in the container headspace is completely eliminated. The plastic petals in the various embodiments of FIGS. 1–14 and 20 conform to the inner contour of the container. The hold-down device is self-aligning in assembly. The hold-down device of the present invention is easily adapted to fit into containers of differing sizes or shapes, and to conform to differing heights of tablet product within the container. The device maintains a constant pressure on the tablet product so that the product does not rattle and potentially become damaged during transport and handling. The hold-down device is separate from the closure, and thus may be used in conjunction with closures of differing sizes and characteristics. A number of modifications and variations have been disclosed. Other modifications and variations will suggest themselves to persons of ordinary skill in the art. The invention is intended to embrace all such modifications and variations as fall within the spirit and broad scope of the appended claims.

What is claimed is:

1. A package that comprises:

a container having an interior volume for holding product, a cylindrical finish terminating in a container mouth, and a circumferential bead extending around an inner periphery of said finish adjacent to said mouth, a closure for external securement to said finish to close said mouth, and a product hold-down device of one-piece integrally molded plastic construction separate from said closure and comprising:

a spiral spring having an open first end of greater diameter received and held in circumferential compression within the container mouth beneath said bead such that said spring is retained within said finish independent of said closure, a second end of lesser diameter, and an axis, a disk coupled to said second end of said spring, said disk lying in a plane perpendicular to said axis, and a plurality of flexible resilient petals extending radially outwardly from a periphery of said disk, said petals being circumferentially spaced around said disk.

2. A package that comprises:

a container having an interior volume for holding product, a cylindrical finish terminating in a container mouth, and a circumferential bead extending around an inner periphery of said finish adjacent to said mouth, a closure for external securement to said finish to close said mouth, and a product hold-down device of one-piece integrally molded plastic construction separate from said closure and comprising:

a spiral spring having an open first end of greater diameter received and held in circumferential compression Within the container mouth beneath said bead such that said device is held within said finish independent of said closure, a second end of lesser diameter and an axis, and a disk coupled to said second end of said spring, said disk lying in a plane perpendicular to said axis.

3. A hold-down device for packaging tablets within a container having a finish with an open mouth, said device comprising:

a circumferentially continuous annular ring having an axis and a radially outwardly projecting bead for securing said device within the finish of a container without extending out of the container mouth, a compression spring extending axially from said ring, a disk coupled to an end of said spring spaced from said ring, said disk lying in a plane parallel to said ring, and a plurality of flexible resilient petals extending radially outwardly from a periphery of said disk, said petals being circumferentially spaced around said disk, said petals having arcuate outer edges on a circle of revolution concentric with said axis, and frangible webs integrally interconnecting radially outer edges of said petals.

4. The device set forth in claim 3 wherein said disk is flat and has a periphery, to which said petals are coupled, concentric with said axis.

5. The device set forth in claim 4 wherein said petals are angulated toward said ring with respect to the plane of said disk.

6. A package that comprises:

a container having an interior volume for holding product, a cylindrical finish terminating in a container mouth, and a circumferential bead extending around an inner periphery of said finish adjacent to said mouth, a closure for external securement to said finish to close said mouth, and a product hold-down device of one-piece integrally molded plastic construction separate from said closure and comprising:

a circumferentially continuous annular ring having an axis and a radially outwardly projecting bead received beneath said bead on said finish such that said ring is retained within said finish independent of said closure, a compression spring extending axially from said ring, said compression spring including a plurality of axially compressible spring bellows, a disk coupled to ends of said plurality of axially compressible spring bellows, spaced from said ring, said disk lying in a plane parallel to said ring, a plurality of flexible resilient petals extending radially outwardly from a periphery of said disk, said petals having arcuate radially outer edges on a circle of revolution that is concentric with said axis and has a diameter that is greater than the outside diameter of said ring, said petals being circumferentially spaced around said disk, and frangible webs integrally interconnecting radially outer edges of said petals.

7. The package set forth in claim 6 wherein said disk is flat and has a periphery, to which said petals are coupled, concentric with said axis.

8. The package set forth in claim 8 wherein said petals are angulated toward said ring with respect to the plane of said disk.

9. A package that comprises:

a container having an interior volume for holding product, a cylindrical finish a terminating in a container mouth, and a circumferential bead extending around an inner periphery of said finish adjacent to said mouth, a closure for external securement to said finish to close said mouth, and a product hold-down device of one-piece integrally molded plastic construction separate from said closure and comprising:

a circumferentially continuous annular ring having an axis and a radially outwardly projecting bead received beneath said bead on said finish such that said ring is retained Within said finish independent of said closure, a compression spring extending axially from said ring, said compression spring including a plurality of axially compressible spring bellows, a flat disk coupled to ends of said plurality of axially compressible spring bellows spaced from said ring, said disk lying in a plane parallel to said ring and having a periphery concentric with said axis, and a plurality of flexible resilient petals connected to and extending radially outwardly from said periphery of said disk, said petals having arcuate radially outer edges on a circle of revolution that is concentric With said axis: and has a diameter that is greater than the outside diameter of said ring, said petals being circumferentially spaced around said disk and being angulated toward said ring with respect to the plane of said disk.

10. A package that comprises:

a container having an interior volume for holding product, a cylindrical finish terminating in a container mouth, and a circumferential bead extending around an inner periphery of said finish adjacent to said mouth, a closure for external securement to said finish to close said mouth, and a product hold-down device of one-piece integrally molded plastic construction separate from said closure and comprising:

a circumferentially continuous annular ring having an axis and a radially outwardly projecting bead received beneath said bead on said finish such that said ring is retained within said finish independent of said closure, a compression spring extending axially from said ring, a flat disk coupled to the end of said compression spring spaced from said ring, said disk lying in a plane parallel to said ring and having a periphery concentric with said axis, and a plurality of flexible resilient petals connected to and extending radially outwardly from said periphery of said disk, said petals having arcuate radially outer edges on a circle of revolution that is concentric with said axis and has a diameter that is greater than the outside diameter of said ring, said petals being circumferentially spaced around said disk and being angulated toward said ring with respect to the plane of said disk.

11. The package set forth in claim 10 wherein said compression spring comprises at least one spiral spring.

12. The package set forth in claim 10 wherein said compression spring comprises at least one coil spring.

13. The package set forth in claim 10 wherein said compression spring comprises a plurality of axially compressible spring bellows.

14. The package set forth in claim 10 further comprising frangible webs integrally interconnecting radially outer edges of said petals.

* * * * *